United States Patent [19]

Dornaus et al.

[11] Patent Number: 4,726,136

[45] Date of Patent: Feb. 23, 1988

[54] FIREARM SAFETY DEVICES

[75] Inventors: Thomas F. Dornaus, Bellflower; Michael F. Dixon, Huntington Beach, both of Calif.

[73] Assignee: Dornaus & Dixon Enterprises, Huntington Beach, Calif.

[21] Appl. No.: 643,254

[22] Filed: Aug. 22, 1984

[51] Int. Cl.[4] ..... F41C 11/02

[52] U.S. Cl. ..... 42/70.08; 42/70.01

[58] Field of Search ..... 42/70.01, 70.08

[56] References Cited

U.S. PATENT DOCUMENTS

| | | | |
|---|---|---|---|
| 580,924 | 4/1897 | Browning | 42/70 R |
| 580,926 | 4/1897 | Browning | 42/70 R |
| 708,794 | 9/1902 | Browning | 89/145 |
| 747,585 | 12/1903 | Browning | 42/70 F |
| 808,003 | 12/1905 | Browning | 42/70 R |
| 954,441 | 4/1910 | Krag | 89/138 |
| 962,137 | 6/1910 | Gates | 89/196 |
| 984,519 | 2/1911 | Browning | 89/145 |
| 989,432 | 4/1911 | Schmeisser | 89/163 |
| 1,028,032 | 5/1912 | Krag | 89/145 |
| 1,105,404 | 7/1914 | Loiselet | 89/196 |
| 1,181,416 | 5/1916 | Wesson | 89/145 |
| 1,618,510 | 2/1927 | Browning | 89/163 |
| 2,846,925 | 8/1958 | Norman | 89/145 |
| 3,110,223 | 11/1963 | Schlappich | 89/196 |
| 4,021,955 | 5/1977 | Curtis | 42/70.08 |
| 4,031,808 | 6/1978 | Raville | 89/163 |
| 4,141,166 | 2/1979 | Schultz | 42/70.8 X |

FOREIGN PATENT DOCUMENTS

| | | | |
|---|---|---|---|
| 146359 | 6/1985 | European Pat. Off. | 42/70.08 |
| 3323501 | 1/1985 | Fed. Rep. of Germany | 42/70.08 |

*Primary Examiner*—Peter A. Nelson

*Attorney, Agent, or Firm*—Morland C. Fischer

[57] ABSTRACT

A firearm is provided having a firing pin block which pulls the firing pin away from the hammer independently of the hammer actuator mechanism. A loaded chamber indicator includes a pivoting indicator lever resistant to breakage and jamming. The firearm also has a reversible thumb safety which is readily inserted, releasably retained and fully operational in either side of the firearm. An ambidextrous thumb safety includes two shaft portions each having integral levers and adapted to mate together to form a single shaft. A selective magazine catch is also provided which allows the shooter to select between a magazine catch mode and a magazine free fall mode.

22 Claims, 20 Drawing Figures

FIG. 18
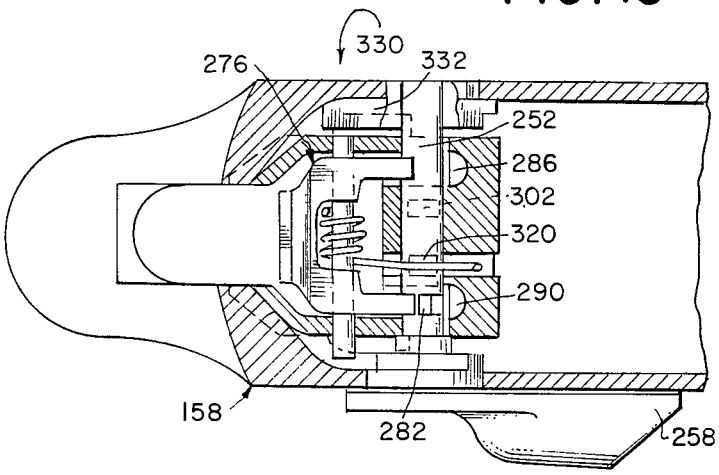
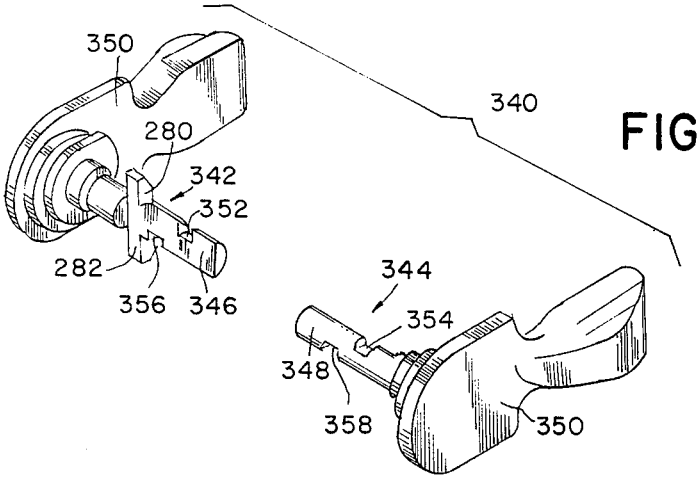
FIG. 19
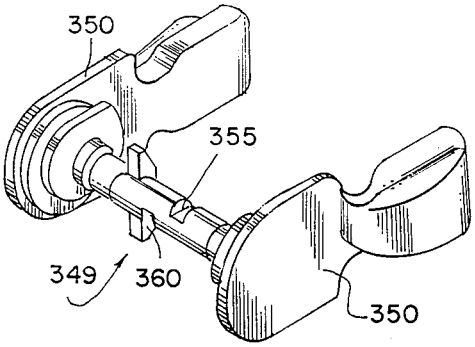
FIG. 20

FIREARM SAFETY DEVICES

BACKGROUND OF THE INVENTION

1. Field of the Invention

The present invention relates to firearms, and more particularly, to devices for facilitating the safe handling of firearms.

2. Description of the Prior Art

Automatic and semiautomatic firearms or guns such as magazine loaded rifles and handguns typically have a firing pin which when struck by the hammer of the firearm, is driven forward striking and discharging the cartridge held within the firing chamber of the firearm. Several devices have been proposed to selectively block the firing pin to prevent the firearm from being accidentally fired. For example, in a semiautomatic handgun, these devices (often referred to as "firing pin blocks") are typically mounted within the frame of the gun and have mechanical linkages to the firing pin itself which is usually carried in the slide of the gun. These previous firing pin blocks have tended to be relatively complicated and, because of their location adjacent the handgrip of the frame, are susceptible to being accidentally disengaged by the shooter. Moreover, many such firing pin block devices do not constantly block the firing pin when activated, but instead cooperate with other mechanisms such as the hammer actuator mechanism to only block the firing pin in certain hammer positions.

Other safety devices include loaded chamber indicators which indicate to the shooter whether a cartridge is seated in the firing chamber in position for firing. Many previous loaded chamber indicators have included a spring-loaded pin which has one end positioned relative to the firing chamber such that a cartridge loaded in the chamber engages and pushes the indicator pin outward. This outward movement of the pin usually causes a portion of the pin to protrude beyond the exterior of the gun providing an indication that a cartridge is loaded in the chamber. These pins are often relatively small in diameter and can be susceptible to breakage. Moreover, dirt lodged against the pin can immobilize the pin causing the gun to jam.

Still another safety device is the thumb safety so called because it is typically actuated by the shooter's thumb. The thumb safety usually locks the gun so that the hammer is prevented from falling even though the trigger is pulled. To activate the safety, most thumb safeties have an exterior lever on the left-hand side of the gun positioned adjacent the thumb of a right-handed user. Pivoting the lever causes the safety to engage and "lock" the hammer actuator.

To accommodate left-handed users, some thumb safeties allow a second lever to be placed on the right-hand side of the gun to form an "ambidextrous" thumb safety. This second lever is often attached to a shaft extending transversely through the gun. One problem experienced with ambidextrous thumb safeties of this type is that the second thumb lever can sometimes work loose from the shaft of the safety so that positive engagement of the safety is not always assured.

Many left-handed shooters prefer to have only the single thumb safety lever on the right-hand side of the gun so that the lever on the left-hand side of the gun is eliminated. However, many guns require such a thumb safety for "lefties" to be custom crafted by a skilled gunsmith.

Other devices for safe handling of firearms relate to the loading and unloading of ammunition. In one type of gun, the cartridges to be fired by the gun are carried in a removable magazine which is inserted into a portion of the frame of the gun often referred to as the "magazine well." In many magazine-type guns, the magazine falls freely from the magazine well under the influence of gravity once released. The released magazine will fall to the ground unless caught by the shooter placing his hand beneath the gun. This is a desirable feature under certain circumstances but requires additional care on the part of the shooter. Other magazine-type guns have a catch mechanism which only allows the magazine to partially drop from the magazine well once released. The shooter may then manually withdraw the magazine the rest of the way from the well. However, it is not believed that there is presently available a magazine-type gun in which the user may select between allowing the magazine to drop freely and allowing the magazine to only partially drop from the well to prevent complete release of the magazine.

SUMMARY OF THE INVENTION

It is an object of the present invention to provide a gun or firearm having safety devices obviating for practical purposes, the above-mentioned limitations.

It is a further object of the present invention to provide a firing pin block which is located on the firearm in such a position so as to minimize accidental release of the firing pin block.

It is another object of the present invention to provide a relatively simple yet effective firing pin block.

It is a further object of the present invention to provide a firing pin block which is independent of the trigger mechanism of the gun.

It is another object of the present invention to provide a loaded chamber indicator which is less susceptible to breakage and to jamming the gun.

It is still another object of the present invention to provide a more reliable ambidextrous thumb safety which is easily disassembled from the gun.

It is a further object of the present invention to provide a reversible thumb safety which is easily installed on either side of the gun without the aid of a gunsmith.

In one aspect of the present invention, a firing pin block is provided which pulls the firing pin towards the muzzle and below the hammer striking surface of the gun to prevent the hammer from being able to reach the firing pin. In the illustrated embodiment, the firing pin block includes a bolt mounted transversely through the slide and adapted to engage and disengage the firing pin as the bolt is moved between "safety" and "fire" positions, respectively.

In another aspect of the present invention, a loaded chamber indicator includes a lever pivoted at one end to the firearm with the free end of the lever positioned adjacent the opening of the firing chamber. A cartridge loaded in the chamber causes the indicator lever to pivot outward providing an indication of the chamber being loaded.

In still another aspect of the present invention, an ambidextrous thumb safety includes a shaft comprising two shaft portions. Each shaft portion has an integral thumb lever at one end and is shaped substantially as a half cylinder at the other end. The two shaft portions are adapted to mate together to form a single shaft.

In an additional aspect of the present invention, a fully reversible thumb safety is provided. In the illustrated embodiment, the thumb safety has a shaft and an integral thumb lever wherein the shaft is readily insertable into either side of the firearm. The shaft has projecting members on either side of the shaft to allow the thumb safety to engage the hammer actuator mechanism regardless of which side of the firearm the thumb safety is installed.

In a further aspect of the present invention, a selective magazine catch is provided in which the magazine may either fall freely or catch in the magazine well after falling a predetermined distance, as desired by the shooter.

BRIEF DESCRIPTION OF THE DRAWINGS

FIG. 18 is a top view of the assembled frame of FIG. 8 showing the safety in the fire position with the lever on the right side of the frame;

FIG. 19 is an exploded perspective view of an ambidextrous thumb safety lever in accordance with a preferred embodiment of the present invention; and FIG. 20 is a perspective view of the assembled ambidextrous thumb safety lever of FIG. 18.

DETAILED DESCRIPTION OF THE DRAWINGS

Figure 1:
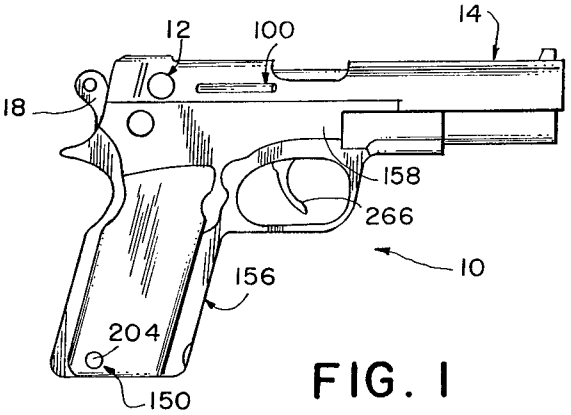
FIG. 1 is a side view of a semiautomatic handgun in accordance with a preferred embodiment of the present invention.

FIG. 1 shows a semiautomatic handgun 10 (hereinafter "gun 10") which incorporates the safety features of the present invention. Although the illustrated embodiments of the present invention are described in connection with such a handgun, it is recognized that these safety features may also be utilized in other types of firearms.

Figure 2:
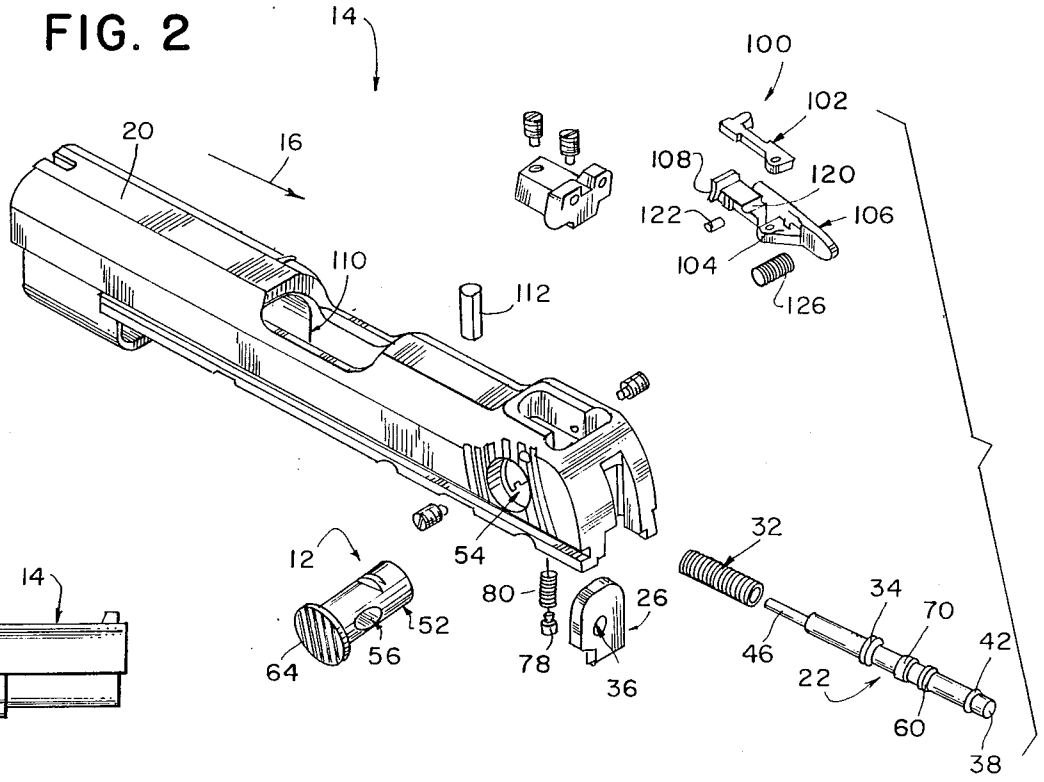
FIG. 2 is an exploded perspective view of the slide assembly of the handgun of FIG. 1 illustrating a loaded chamber indicator and a firing pin block in accordance with a preferred embodiment of the present invention.
Figure 3:
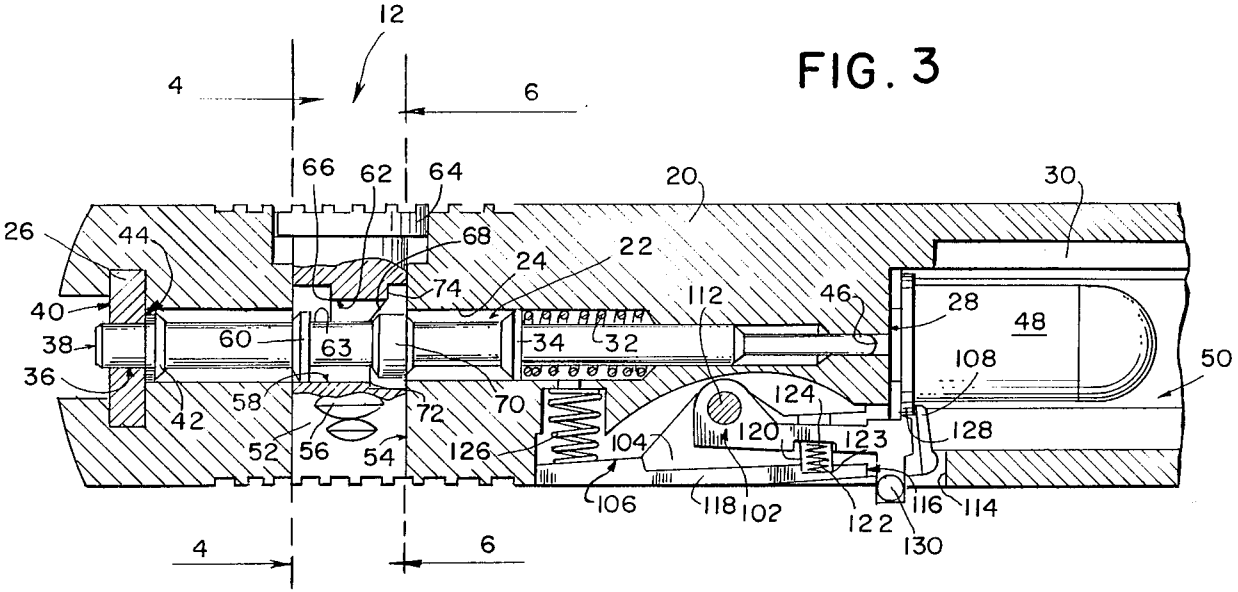
FIG. 3 is an assembled cross-sectional view of the slide assembly of FIG. 2 showing the firing pin block in the fire position and the loaded chamber indicator with a cartridge loaded into the chamber.

The gun 10 has in accordance with one aspect of the present invention, a firing pin block mechanism 12 which may be seen more clearly in FIG. 2 which is an exploded view of the slide assembly 14 of the gun 10. In a manner well understood in the art, the slide assembly 14 moves sharply rearward (as indicated by the arrow 16) after a shot has been fired, to eject the spent cartridge and recock the hammer 18 (FIG. 1). Housed within the slide body 20 of the slide assembly 14 is the firing pin 22 as shown in FIG. 3. The firing pin 22 is carried in a generally cylindrical bore 24 which longitudinally extends from a firing pin retainer plate 26 to the breech face 28 adjacent the end of the barrel 30.

A spring 32 engaging a collar 34 of the firing pin 22 urges the firing pin rearward towards the retainer plate 26. The retainer plate 26 has an aperture 36 which allows the end 38 of the firing pin 22 to protrude beyond the hammer striking surface 40 of the retainer plate 26 until a collar 42 of the firing pin 22 engages the other side 44 of the retainer plate 26. The hammer 18 when released, is driven forward by a spring (not shown) causing the hammer 18 to strike the end 38 of the firing pin 22. This in turn drives the firing pin 22 forward causing the other end 46 of the firing pin to strike the primer of the cartridge 48 loaded within the chamber 50 of the gun 10.

In accordance with the present invention, the firing pin block 12 when engaged, pulls the end 38 of the firing pin 22 below the hammer striking surface 40 of the retainer plate 26 so that the hammer 18 cannot reach the end 38 of the firing pin 22. In addition, as will be more fully described below, the firing pin block 12 also blocks the firing pin 22 from reaching the cartridge 48.

Referring to both FIGS. 2 and 3, the firing pin block 12 includes a bolt 52 which is carried in a generally cylindrical bore 54 extending transversely across the slide body 20 and intersecting the firing pin bore 24. The bolt 52 has a noncircular opening 56 through which the firing pin 22 moves to strike the cartridge 48 if the bolt 52 is in the position illustrated in FIG. 3 and hereinafter referred to as the "fire" position.

Figure 4:
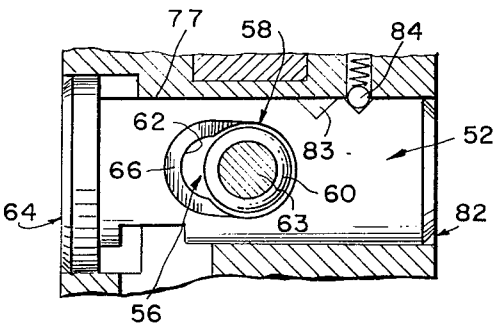
FIG. 4 is a front view of the bolt of the firing pin block viewed along the line 4—4 of FIG. 3.

The noncircular opening 56 of the bolt 52 may be seen more clearly in FIG. 4 which shows a front view of the bolt 52. As shown therein, the opening 56 is generally "keyhole" in shape and includes a first opening 58 which has an inner diameter exceeding that of a collar 60 (FIG. 3) on the firing pin 22. When the bolt 52 is in the fire position as illustrated in FIG. 3, the opening 58 of the bolt 52 is centered relative to the center axis of the firing pin 22 so that the collar 60 of the firing pin 22 can freely travel through the bolt 52 to strike the cartridge 48.

However, overlapping the opening 58 is a second smaller opening 62 of the bolt. The diameter of the opening 62 is slightly larger than the main shaft 63 of the firing pin 22 but is significantly smaller than the outer diameter of the pin collar 60. When the head 64 of the bolt 52 is pressed inward to the position illustrated in FIG. 5 (hereinafter referred to as the "safety" position), the opening 62 is centered with respect to the center axis of the firing pin 22 so that the collar 60 of the firing pin 22 is prevented from passing through the opening 56 of the bolt 52. The constricted opening 62 has a flat ledge 66 at its periphery to securely seat the collar 60 if the firing pin 22 should move toward the cartridge to effectively block the pin 22.

Figure 6:
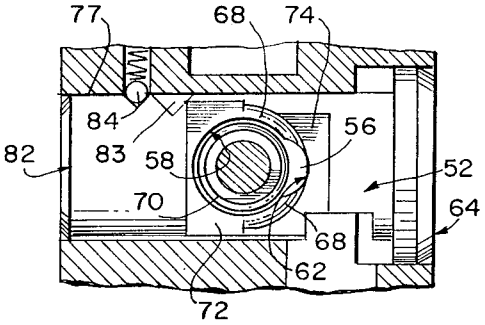
FIG. 6 is a rear view of the bolt of FIG. 1 viewed along the line 6—6 of FIG. 3.
Figure 5:
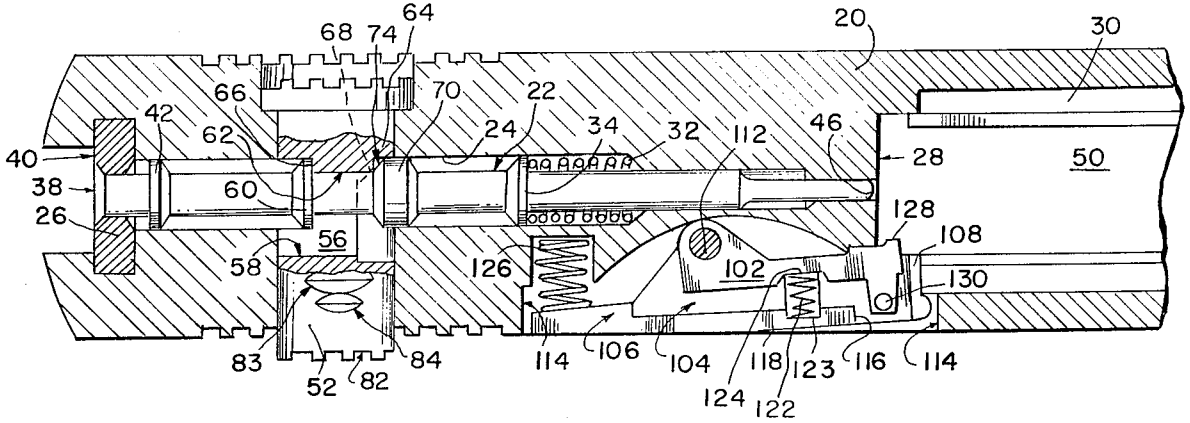
FIG. 5 is an assembled cross-sectional view of the slide assembly of FIG. 1 showing the fire pin block in the safety position and the loaded chamber indicator without a cartridge in the chamber.

In addition, the bolt 52 has a camming surface 68 on its rear side adjacent the opening 56, which engages another collar 70 of the firing pin 22 as the bolt 52 is pushed to the safety position of FIG. 5. As best seen in FIG. 6, the camming surface 68 rises from a lower shelf 72 at the periphery of the larger opening 58 to an upper shelf 74 at the periphery of the smaller opening 62. The camming surface 68 is generally cylindrical in shape and is formed by boring the bolt 52 at an angle relative to the central axes of the openings 58 and 62.

Because the upper shelf 74 is closer (FIG. 5) to the muzzle than the lower shelf 72, engagement of the firing pin collar 70 by the camming surface 68 as the bolt 52 is pushed towards the safety position of FIG. 5, pushes the firing pin 22 towards the muzzle and away from the hammer. The displacement between the lower shelf 72 and upper shelf 74 is sufficiently large to move the end 38 of the firing pin 22 completely below the hammer striking surface 40 of the retainer plate 26. Consequently, the hammer cannot reach the firing pin when the bolt 52 is fully in the safety position illustrated in FIG. 5. Furthermore, the ledge 66 (FIG. 4) on the front of the bolt 52 prevents the firing pin 22 from being able to reach the primer of the cartridge within the gun chamber as previously described.

To releasably hold the bolt 52 in the respective fire and safety positions, the bolt 52 has a pair of indentations 83 and 84 on its upper surface 77 and positioned to engage a detent 78 (FIG. 2) biased downward from the top of the slide body 20 by a spring 80. The detent 78 engages the indentation 84 (FIG. 4) when the firing pin block bolt 52 is in the fire position. Depressing the head 64 of the bolt 52 causes the detent 78 to ride up out of the indentation 84 and fall into the other indentation 83 when the bolt 52 is pressed into the safety position. Pressing the opposite head 82 of the bolt 52 returns the bolt to the fire position. The bolt heads 64 and 82 may be marked with suitable indices such as "S" and "F", respectively.

It is seen from the above that the firing pin block 12 provides a simple yet effective mechanism for preventing accidental discharge of the firearm. The firing pin block 12 is independent of all other trigger and safety mechanisms and accordingly is always in action when actuated. Furthermore, because the firing pin block is located completely in the slide assembly 14 and away from the hand grip 156 (FIG. 1), the likelihood of accidental disengagement of the firing pin block is correspondingly reduced.

FIG. 2 also shows a loaded chamber indicator 100 in accordance with a preferred embodiment of the present invention. The loaded chamber indicator 100, as its name suggests, indicates to the shooter whether a cartridge is loaded in the firing chamber of the pistol when the slide assembly 14 is in the fully forward position illustrated in FIG. 1.

Figure 7:
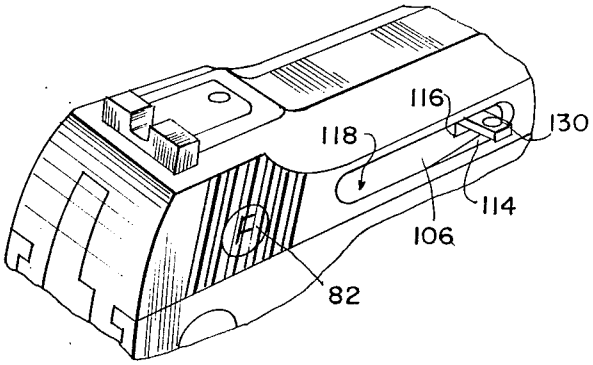
FIG. 7 is a partial perspective view of the assembled loaded chamber indicator of FIG. 2.

In accordance with the present invention, the loaded chamber indicator 100 includes an indicator lever 102 which is pivotally coupled to the slide body 20 of the slide assembly 14. When assembled, the lever 102 is carried in a flat depression 104 of the cartridge extractor lever 106. The extractor lever 106 and indicator lever 102 pivot around a common pivot pin 112 within an extractor slot 114 (FIG. 7). As best seen in FIGS. 3 and 7, the extractor slot is provided on the right side of the slide body 20 and extends rearward from the breech face 28.

The extractor lever 106 has a small hooked portion 108 which engages the base (FIG. 3) of the cartridge loaded in the firing chamber. As the slide assembly 14 retracts after the cartridge has been fired, the extractor lever 106 hooked to the base of the cartridge pulls the expended casing from the firing chamber, to be ejected out through ejection port 110 (FIG. 2) of the slide body 20.

In the illustrated embodiment, the extractor lever 106 has an aperture 116 in the exterior face portion 118, which communicates with the flat depression 104. The extractor lever 106 further has a cylindrical depression 120 which carries a spring 122 biasing the indicator lever 102 in a counterclockwise direction as viewed in FIG. 3. One end of the spring 122 seats in a notch 124 of the indicator lever 102 and the other end seats within a depression 123 on the inner side of the exterior face portion 118 of the extractor lever 106. A second spring 126 also biases the extractor lever 106 in a counterclockwise direction.

When a cartridge is loaded in the firing chamber 50, the exterior of the cartridge casing engages an engagement surface 128 on the inner side of the indicator lever 102, thereby pushing the indicator lever 102 outward in a clockwise direction to the "chamber loaded" position of FIGS. 3 and 7. Thus, when seated, the cartridge 48 causes protrusion portion 130 on the other side of the indicator lever 102 to protrude approximately 1/16th of an inch beyond the exterior of the extractor face portion 118 through the aperture 116 of the extractor lever 106. The protrusion portion 130 provides a visual and tactile indication that a cartridge is loaded in the firing chamber. The tip of the protrusion portion 130 may be painted a bright color such as red to further enhance the visibility of that portion of the lever.

On the other hand, if there is no cartridge in the firing chamber, the indicator lever 102 is pivoted in a counterclockwise direction by the spring 122 towards the interior of the firing chamber to the "chamber empty" position of FIG. 5. Consequently, the tip of the protruding portion 130 of the indicator lever 102 is moved inward (FIG. 5) so that it is flush with (or somewhat interior of) the exterior face portion 118 of the extractor lever 106. This indicates to the shooter that the firing chamber is empty.

Because the indicator lever 102 is carried in a depression of the extractor lever 106, a separate slot or aperture need not be machined into the slide body 20 for the indicator lever 102. Instead, the indicator lever 102 utilizes the slot 114 already provided for the extractor lever 106. This saves an additional machining step and reduces the number of access points for dirt to enter the interior of the gun. Furthermore, the extractor lever 106 and the upper surface of the slot 114 protect the lever 102. Thus, the lever arrangement of the indicator 100 has been found to be less susceptible to jamming and breakage than many previous loaded chamber indicators.

Figure 8:
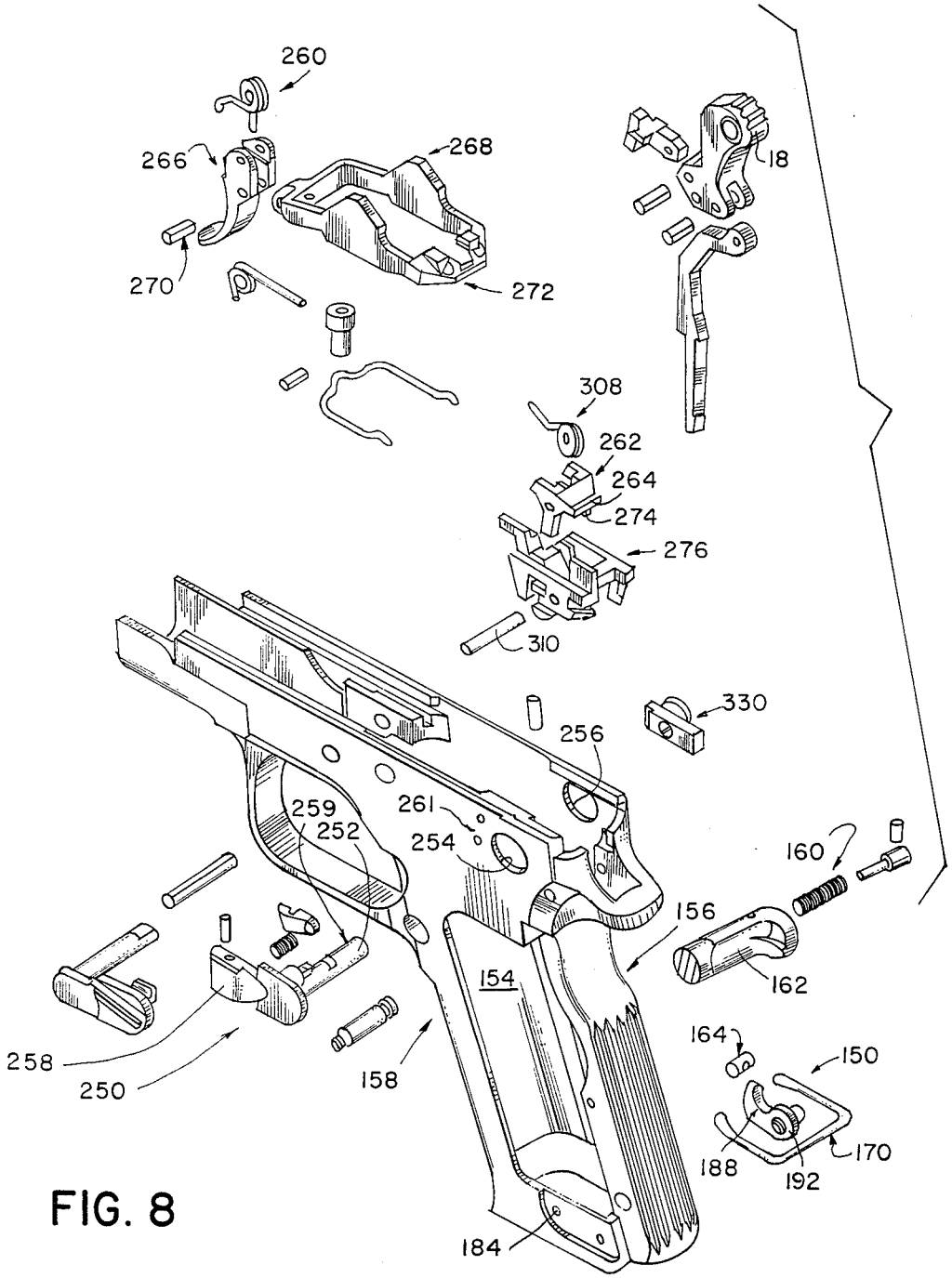
FIG. 8 is an exploded perspective view of the frame of the handgun of FIG. 1 illustrating a reversible thumb safety and selective magazine catch in accordance with a preferred embodiment of the present invention.

FIG. 8 shows an exploded view of a selective magazine catch assembly 150 in accordance with a preferred embodiment of the present invention. The magazine 151

(FIG. 9) for housing the cartridges is inserted through an aperture 152 in the frame 158 to the magazine well 154 defined by the handgrip 156 of the handgun frame 158. The magazine when fully inserted into the magazine well 154, is releasably retained within the well by a suitable magazine retainer mechanism 160. The retainer mechanism 160 includes a release button 162 which when depressed, causes the mechanism 160 to release the magazine from the magazine well 154.

In accordance with the present invention, the selective magazine catch 150 allows the shooter to select either of two magazine removal modes. In one mode, the magazine 151 is allowed to fall freely from the magazine well 154 when the release button 162 is depressed. Alternatively, in the second mode, the magazine catch 150 catches the magazine after it has fallen a predetermined distance. The shooter may then manually extract the magazine the rest of the way from the magazine well 154.

Figure 9:
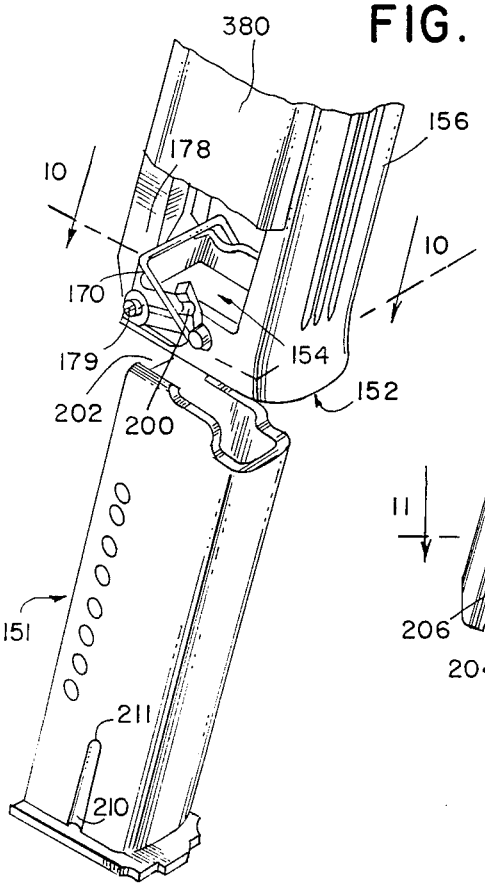
FIG. 9 is a perspective view of the selective magazine catch of FIG. 8.
Figure 10:
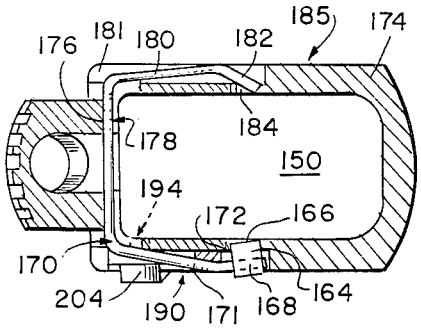
FIG. 10 is a cross-sectional view of the selective magazine catch of FIG. 9 viewed along the line 10—10.

Referring to FIGS. 8–10, the selective magazine catch 150 includes an engagement member 164 having a rounded engagement surface 166 at one end. The engagement member 164 further has a generally cylindrical bore 168 adapted to receive one end of a generally U-shaped spring 170 having legs 171 and 180. As best seen in FIG. 10, the engagement member 164 is carried in a cylindrical bore 172 at one side 190 of the base 174 of the frame hand grip 156. The spring 170 is mounted on the base 174 as shown in FIGS. 9 and 10 with the cross portion 176 between the spring legs 171 and 180 seated in a notch 178 in the handgrip 156. The other leg 180 of the spring 170 has a hooked end 182 which is seated in a bore 184 on the opposite side 185 of the base 174. The spring 170 urges the engagement member inward toward the magazine well.

The magazine catch 150 further includes a cam lever 188 which is placed between the spring leg 171 and the base side portion 190. The cam lever 188 is adapted to pivot about a round protrusion 192 (FIG. 8) which is inserted into a bore 194 in the base side portion 190.

In order to move the engagement member 164 between a "withdrawn" position (FIGS. 9 and 10) and an "engagement" position (FIGS. 11 and 12 respectively), the cam lever 188 has a camming surface 198 on its exterior side for engaging the spring leg 171. The withdrawn and engagement positions of the member 164 correspond to the free fall and catch modes, respectively.

Figure 11:
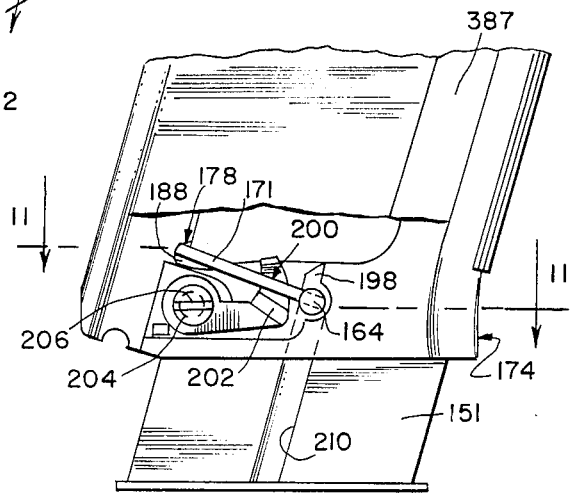
FIG. 11 is a side view of the selected magazine catch of FIG. 9 in the catch position showing a magazine partially dropped out.

The camming surface 198 includes a pair of generally trough-shaped depressions 200 and 202 positioned on the cam lever 188 to alternately receive the spring leg 171 when the cam lever 188 is in the positions of FIGS. 11 and 9, respectively. The cam lever 188 further has a second protruding member 204 axially aligned with the protruding member 192 on the other side of the level 188. The member 204 defines a slot 206 to provide a manually actuable control member for pivoting the cam lever 188 between the positions illustrated in FIGS. 9 and 11. A screw driver is recommended to actuate the control member 204.

The depression 202 is machined to space the spring leg 171 from the base side portion 190 so as to position the engagement member 164 in the "withdrawn" position illustrated in FIG. 10. As shown therein, the engagement member 164 does not protrude beyond the inner face 206 of the base side portion 190. Consequently, the engagement member 164 does not interfere with the free fall of the magazine 151 from the magazine well 154 when released by the mechanism 160.

Alternatively, when the cam lever 188 is pivoted so that the spring leg 171 falls into the other depression 200 as shown in FIG. 11, because the depression 200 is deeper than the depression 202, the spring leg 171 is spaced closer to the base side portion 190. As a result, the engagement member 164 protrudes beyond the inner face 206 under the urging of the spring 170. As shown in FIG. 9, the magazine 151 has an indentation 210 which extends a predetermined distance from the base of the magazine. When the magazine is released, the engagement member 164 engages the end 211 of the indentation 210 after the magazine has fallen the predetermined distance thereby catching the magazine. The shooter may then manually extract the magazine the rest of the way from the magazine well 154 causing the engagement member 164 to be pushed back into the bore 172 against the spring 170.

Figure 12:
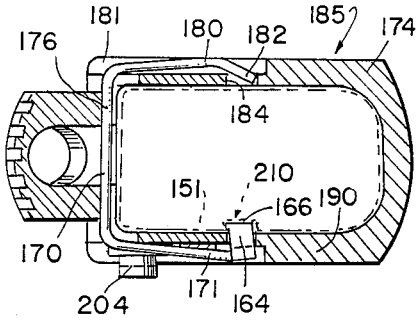
FIG. 12 is a cross-sectional view of the selective magazine catch of FIG. 11 viewed along the line 11—11.

It is evident from the above that the magazine catch 150 allows the shooter to select between either the magazine freefall mode (FIGS. 9 and 10) or the magazine catch mode (FIGS. 11 and 12). To facilitate the movement of the cam lever 188 between the two positions of FIGS. 9 and 11, the camming surface 198 between the troughs 200 and 202 may be rounded. The magazine catch 150 is disposed in depressions 179 and 181 at the frame base 174 to allow the handgrips stocks 380 and 382 to be placed over the magazine catch 150 with the control member 204 accessible through an aperture in the stock 380 as shown in FIG. 1.

FIG. 8 also shows a thumb safety 250 which, in accordance with the present invention, is fully reversible so that the shaft 252 of the thumb safety 250 may be inserted into either side of the firearm frame 158. In this manner, the thumb safety 250 is conveniently usable by either right or left-handed shooters.

The shaft 252 of the safety 250 has an integral lever 258 at one end, by which the shaft 252 may be manually pivoted between a "fire" position and a "safety" position discussed below. The free end 259 of the shaft 252 is inserted transversely across the frame 158 through one of the apertures 254 or 256 of the frame 158. When the shaft 252 is inserted through the left-hand aperture 254 so that the lever 258 is also on the left side of the frame 158, the shaft 252 defines a "left-handed" transverse position, for a right handed shooter. Alternatively, when the shaft 252 is inserted through the right-hand aperture 256 so that the lever 258 is also on the right side of the frame 158, the shaft 252 defines a "right-handed" transverse position, for a left handed shooter.

Each shaft transverse position has associated therewith a "fire" position and a "safety" position in which, in the illustrated embodiment, the fire positions correspond to the lever being oriented generally horizontal while the safety positions correspond to the lever being pivoted upward a predetermined angular distance. In either transverse position of the shaft 252, the lever 258 is pointed generally forward so that the shaft 252 is generally upside down in one transverse position relative to the other transverse position. A suitable detent mechanism 159 cooperates with depressions 261 on both sides of the frame to releasably hold the lever 258 in the fire and safety positions.

The handgun 10 of the illustrated embodiment is of a type in which the hammer actuator mechanism 260 includes a sear 262 which has a rearward pointing ledge 264 which releasably supports the spring-loaded hammer 18 in the cocked position. When the trigger 266 is pulled, a trigger bar 268 coupled to the trigger 266 by a pivot pin 270, is pushed rearward. The end 272 of the trigger bar 268 engages a pair of downward extending levers 274 of the sear 262 causing the sear 262 to pivot in a counterclockwise direction (as viewed in FIG. 8) within the sear housing 276. This pivotal movement of the sear 262 moves the sear ledge 264 out of the way of the hammer 18 allowing the hammer to fall and strike the firing pin 22 (FIG. 2). However, as explained below, when the safety shaft 252 is in either of the safety positions, the sear 262 is prevented from pivoting out of the way of the hammer 18 thereby preventing discharge of the gun.

Figure 13:
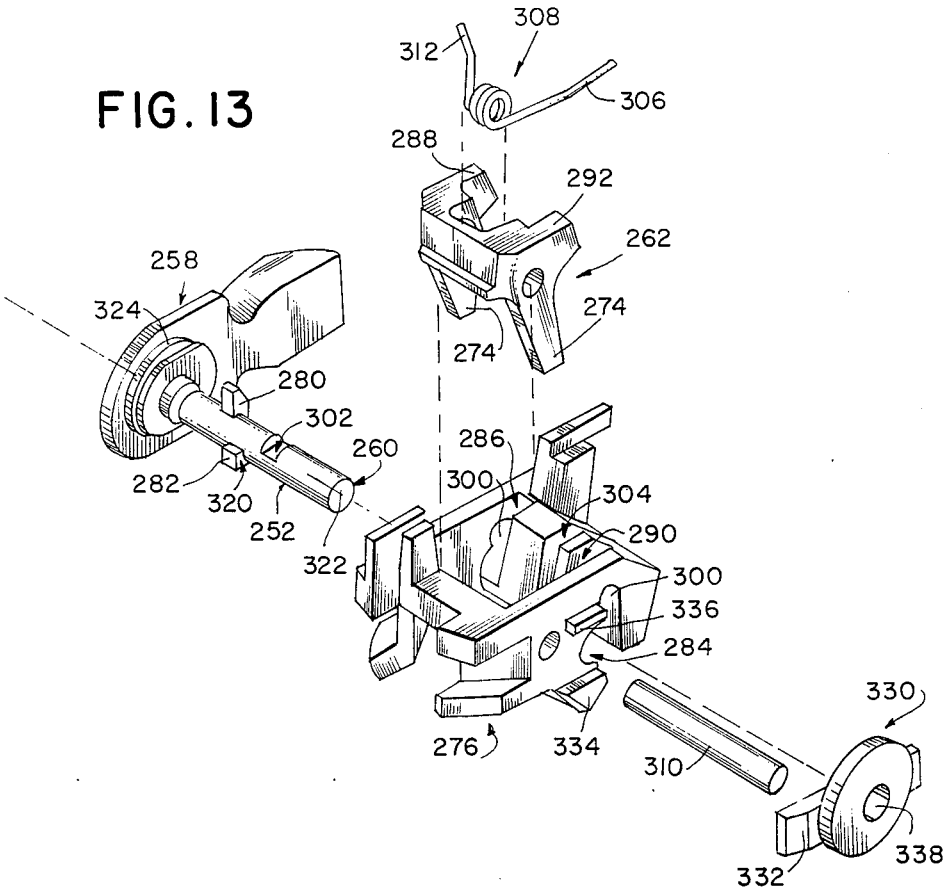
FIG. 13 is an exploded perspective view of the reversible thumb safety of FIG. 8.
Figure 14:
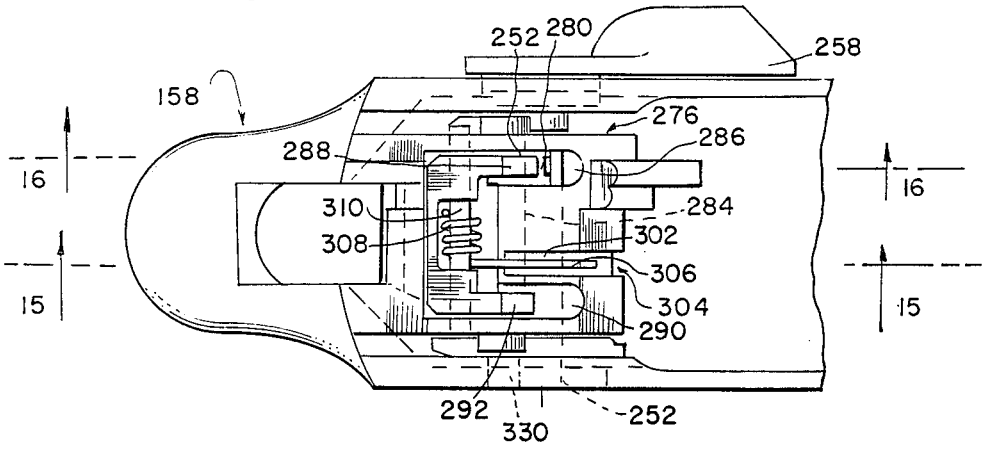
FIG. 14 is a top view of the assembled frame of FIG. 8 showing the safety in the fire position with the lever on the left side of the gun.

As shown in FIG. 13, the safety shaft 252 has a pair of vertical projecting members 280 and 282 extending in opposite directions. When assembled in the sear housing 276, the shaft 252 is pivotally carried within a cylindrical bore 284 (FIG. 14) extending transversely through the sear housing 276. The sear housing 276 has a left-hand slot 286 adjacent the bore 284 which allows the projecting members 280 and 282 to pivot within the sear housing 276.

Figure 16:
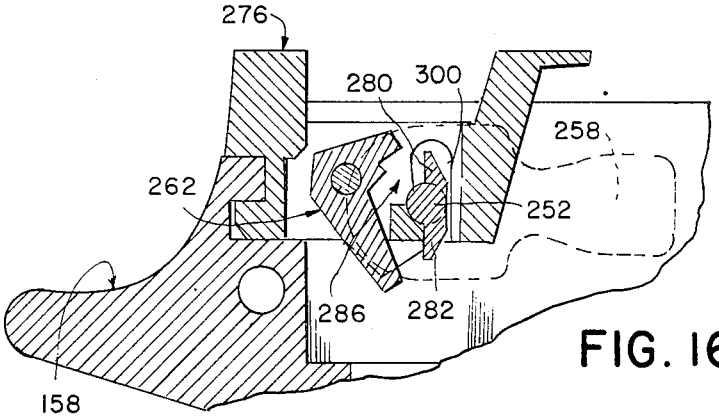
FIG. 16 is a cross-sectional view of the safety of FIG. 14 viewed along the line 16—16.
Figure 17:
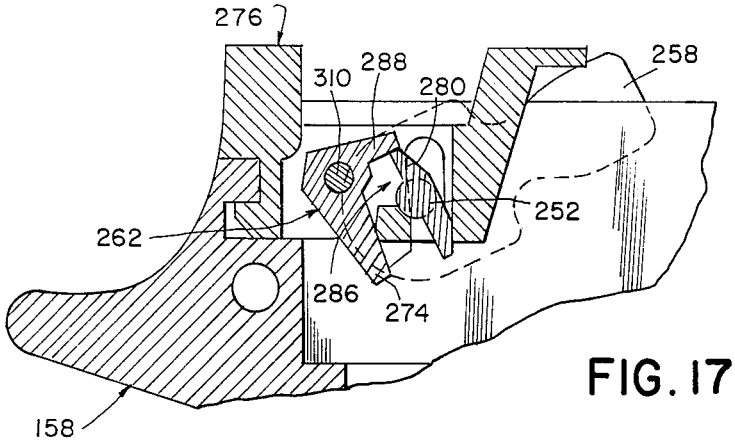
FIG. 17 is a cross-sectional view of the safety of FIG. 14 showing the safety in the safety position.

In the fire positions, the projecting members 280 and 282 are oriented vertically so that the sear 262 can pivot unhindered by the shaft projecting member. Thus, as shown in FIG. 16, with the shaft 252 inserted through the frame lefthand aperture 254 so that the safety lever 258 is on the left-hand side of the gun, the projecting member 280 is clear of the sear 262 when the lever 258 is oriented horizontally corresponding to the fire position. However, should the safety lever 258 be pivoted in a clockwise direction (as viewed in FIG. 17), approximately 20 degrees to the safety position, the shaft projecting member 280 will be pivoted rearward towards the sear 262. In this position, if the trigger 266 is pulled, the shaft projecting member 280 will engage an opposing projecting member 288 of the sear 262, thereby preventing the sear 262 from pivoting and the gun from being discharged.

FIG. 18 shows the safety shaft 252 inserted through the right-hand frame aperture 256. The sear housing 276 has a second (right-hand) slot 290 similar to the left-hand slot 286 on the other side of the sear housing to accommodate the pivoting of the projecting members 280 and 282. With the safety shaft 252 in the right-hand transverse position shown in FIG. 18, the other shaft projecting member 282 is now projecting upward from the shaft. When the safety lever 258 is pivoted to the safety position, the projecting member 282 is moved below an opposing projecting member 292 (FIG. 13) similar to the projecting member 288 on the other side of the sear 262. Should the trigger be pulled with the shaft 252 in the safety position, the projecting member 282 will engage the opposing projecting member 292 of the sear preventing the sear from releasing the hammer. Thus, it is seen that the projecting members 280 and 282 allow the thumb safety 250 to be fully operational whether installed on the left-hand or the right-hand side of the frame.

Figure 15:
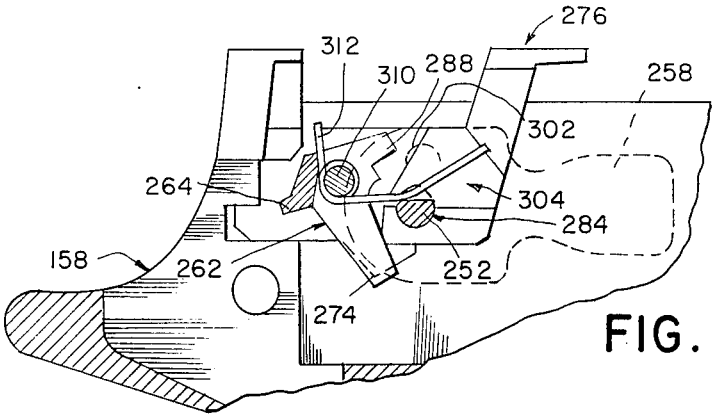
FIG. 15 is a cross-sectional view of the safety of FIG. 14 viewed along the line 15—15.

The sear housing 276 has longitudinal apertures 300 on either side of the sear housing 276 to accommodate the shaft projecting members 280 and 282 as they are inserted into the slots 286 or 290. To releasably retain the shaft 252 in the left-hand transverse position within the sear housing 276, the shaft 252 has a first notch 302 (FIG. 13) positioned on the shaft so that it is aligned with a slot 304 (FIGS. 14 and 15) in the sear housing adjacent the bore 284 when the shaft 252 is inserted into the sear housing 276 in the left-hand transverse position. Engaging both the shaft notch 302 and the housing slot 304 is the leg 306 of a sear spring 308 which biases the sear 262 in a counterclockwise direction as viewed in FIG. 15. The coil of the sear spring 308 is carried on a pin 310 which pivotally supports the sear 262 within the sear housing 276. The other end 312 of the sear spring 308 engages the sear 262 to bias it in the hammer support position.

With the sear spring leg 306 disposed on the aligned shaft notch 302 and housing slot 304, the shaft 252 is locked against substantial transverse motion but the sear spring leg 306 does not prevent the pivotal movement between the safety and fire positions previously described. To release the shaft 252 to allow the shaft to be inserted into the other side of the gun frame, one merely pries the spring leg 306 upward out of the shaft notch 302 freeing the shaft 252 to be pulled out. The shaft 252 has a second notch 320 (FIG. 13) positioned to align with the housing slot 304 when the shaft 252 is inserted from the other side as illustrated in FIG. 18.

Since the spring leg 306 is biased downward, the end of the shaft 252 has a camming surface 322 (FIG. 13) which pries the spring leg 306 upward as the shaft is inserted through the sear housing bore 284 with the lever 258 oriented vertically. Once the spring leg 306 is pried upward, the safety lever 258 may be pivoted forward which further pries the spring leg 306 upward to allow the shaft 252 to be inserted the rest of the way into the sear housing 276. When the shaft notch 302 (or 320) reaches the housing slot 304, the sear spring leg 306 snaps down into the notch retaining the shaft 252 within the sear housing.

Concentric with the shaft 252 is a circular shoulder 324 (FIG. 13) on the lever 258, which is adapted to slidingly mate with the walls of the particular aperture 254 or 256 through which the shaft 252 is inserted. The safety 250 further includes a bushing 330 which is inserted into either of the apertures 254 or 256. The free end of the shaft 252 is inserted into an axially, aligned bore 338 of the bushing 330. The bushing 330 has a shelf member 332 which engages opposing flange members 334 and 336 to support the sear housing.

Thus, to reverse the thumb safety, the safety shaft 252 is released by prying up the spring by 306 and removing the shaft 252. This allows the sear housing to be removed and reinstalled with the bushing 330 on the other side of the frame. The safety shaft is then reinserted from the other side until the spring retainer again locks the shaft into place. It is seen from the above that the thumb safety 250 is capable of being easily installed on the either side of the gun by the typical user without the aid of a gunsmith.

FIG. 19 shows an exploded view of alternative embodiment of the safety shaft of FIGS. 13–17. The safety shaft 340 of FIG. 18 is part of an ambidextrous thumb safety and includes two shaft portions 342 and 344. The shaft portion 342 has one end 346 which is shaped substantially as a half cylinder and is adapted to mate with a similarly shaped end 348 of the other shaft portion 344. When mated, the shaft portions 342 and 344 form a complete shaft 349 as shown in FIG. 19. Each shaft portion has an integrally formed lever 350 similar to the shaft lever 248 of FIG. 12.

As shown in FIGS. 18 and 19, the shaft portion 342 has a notch 352 which is positioned to align with a notch 354 of the other shaft portion 344 when the shaft portions 342 and 344 are mated together. The notches 352 and 354 of the two shaft portions form a single notch 355 similar to the notch 302 of the previous embodiment so that the sear spring leg 306 cooperates with both of the notches 352 and 354 and the sear housing notch 304 to releasably retain both shaft portions 342 and 344 in the sear housing 276. A second pair of notches 356 and 358 on the other sides of the shaft portions 342 and 344, respectively, form a second complete notch 360 similar to the notch 320 of FIG. 12 to allow the shaft portions to be reversed so that it doesn't matter which shaft portion is inserted through which frame aperture.

It has been found that the split shaft safety 340 with integral shaft levers 350 provides a stronger and more reliable ambidextrous thumb safety mechanism than many previous ambidextrous safeties. Furthermore, the above described spring and notch arrangement allows for the rapid release and reinstallation of the shaft portions.

It will, of course, be understood that modifications of the present invention, in its various aspects will be apparent to those skilled in the art, some being apparent only after study and others being merely matters of routine mechanical design. For example, the above-described safety devices can be utilized on other types of firearms. Other embodiments are possible with the specific designs dependent on the particular application. As such, the scope of the invention should not be limited by the particular embodiments herein described which should be defined only by the appended claims and equivalents thereof.

We claim:

1. A firing pin block for a gun having a body and a firing pin for striking a cartridge in the gun, comprising:

a bolt adapted to slide transversely through said body between a "fire" position and a "safety" position, said bolt having a non-circular opening through which the firing pin travels;

wherein the firing pin has a first collar and the bolt opening is constricted at one side so that the outer diameter of the pin collar exceeds the inner diameter of the opening at the constricted side, said collar being located on the pin so that when the bolt is in the safety position, the constricted side of the bolt opening prevents the firing pin collar from passing through the bolt opening and thereby preventing said firing pin from reaching the cartridge.

2. The firing pin block of claim 1 wherein the gun has a hammer for striking the firing pin at one end of the pin and the firing pin further has a second collar spaced from the first collar and the bolt has a camming surface shaped and positioned to engage the second firing pin collar and move the firing pin away from the hammer as the bolt is moved from the fire position to the safety position.

3. The firing pin block of claim 2 wherein the gun has a hammer striking surface which defines a hole through which said one end of the firing pin protrudes to be struck by the hammer, said second collar and camming surface being shaped so as to withdraw said one end of the firing pin below the surface of the gun hammer striking surface to prevent the hammer from reaching said one end of the firing pin.

4. The firing pin block of claim 1 further comprising a detent wherein the bolt defines a pair of depressions spaced on the bolt so that the detent releasably engages the first and second depressions to releasably hold the bolt in the fire and safety positions, respectively.

5. In a gun having a spring-loaded hammer, a trigger and a sear cooperating with the trigger to releasably support the hammer until the trigger is pulled, the improvement comprising:

a safety having a shaft extending transversely through the gun, said shaft comprising two axially aligned shaft portions, each shaft portion having an end shaped substantially as a half cylinder and adapted to mate with the other half cylindrically shaped shaft portion when assembled to form a complete cylinder, each shaft portion having an integral manually actuable lever at the other end of the shaft portion for pivoting the safety shaft when assembled between a "fire" position and a "safety" position, and at least one of said shaft portions having means for engaging the sear to prevent release of the support of the hammer when the safety shaft is in the safety position.

6. The gun of claim 5 wherein each half cylindrically shaped end of the shaft portions defines a notch positioned to align with the notch of the other shaft portion when assembled, the gun further comprising retainer means for simultaneously engaging both shaft portion notches to retain the shaft portions together.

7. The gun of claim 6 further comprising a sear housing for pivotally supporting the sear and the safety shaft, and a spring having a leg for biasing the sear in the hammer support position, wherein the retainer means comprises a slot defined by the sear housing adjacent the safety shaft portion notches and further comprises the spring leg being carried in the sear housing slot and the shaft portion notches.

8. The gun of claim 5 wherein the shaft is pivotal between a second "fire" position and a second "safety" position by the shaft levers when the transverse position of the shaft is reversed, and the gun further comprises a second means on at least one of the shaft portions for engaging the sear to prevent release of the support of the hammer when the safety shaft is in the second safety position.

9. In a gun having a spring-loaded hammer, a trigger, and a sear cooperating with the trigger to releasably support the hammer until the trigger is pulled, the improvement comprising:

a reversible safety comprising a shaft having a manually actuable lever at one end and a free end adapted to be inserted transversely through the gun selectively from either side of the gun, said shaft defining a first transverse position when the free end is inserted from one side and defining a second transverse position when the shaft free end is inserted from the other side of the gun, said lever for pivoting the shaft between a first "fire" position and a first "safety" position when the shaft is in the first transverse position, said lever further for pivoting the shaft between a second "fire" position and a second "safety" position when the shaft is in the second transverse position, said shaft having means for engaging the sear to prevent release of the hammer when the shaft is in either of said first or second safety positions associated with said first and second transverse positions, respectively.

10. The gun of claim 9 wherein the shaft engagement means comprises a pair of projecting members extending in substantially opposite directions, each shaft projecting member for engaging the sear when the shaft is in one of said safety positions associated with said first and second transverse positions.

11. The gun of claim 10 wherein the sear also has a pair of projecting members, each sear projecting member being positioned to be engaged by one of said shaft projecting members when the shaft is in a safety position associated with that shaft projecting member.

12. The gun of claim 9 further comprising means for releasably retaining the shaft when the shaft is in either of the first or second transverse positions.

13. The gun of claim 12 wherein the gun has a sear housing for pivotally supporting the sear and the shaft and a spring having a leg for biasing the sear in the hammer support position, wherein the retaining means comprises a pair of notches defined by the shaft and a slot defined by the sear housing, said notches being positioned on the shaft so that the housing slot is aligned with one shaft notch when the shaft is in the first transverse position and is aligned with other shaft notch when the shaft is in the second transverse position, said retaining means further comprising said leg of the spring carried within the sear housing slot and one of said shaft notches wherein the shaft may be released by lifting the spring leg out of the associated shaft notch.

14. In a gun having a firing pin which has one end protruding beyond a hammer striking surface and adapted to be struck at said one end causing the other end of the pin to strike a cartridge within the gun, the improvement comprising:

means for withdrawing and releasably holding the firing pin below the hammer striking surface to prevent the hammer from reaching the firing pin.

15. The gun of claim 14 wherein the withdrawing and holding means comprises a movable member and a camming surface carried on one of said member or firing pin and adapted to engage the other of said member or pin to withdraw the pin.

16. The gun of claim 14, said improvement further comprising a firing pin block bolt having relatively large and small diameter openings formed therein, said bolt being movable to either a free position for bringing said relatively large diameter opening into alignment with the longitudinal axis of said firing pin or to a safety position for bringing said relatively small diameter opening into alignment with the longitudinal axis of said firing pin, said relatively large and small diameter openings being particularly sized relative to said firing pin, so that when said bolt is moved to the fire position, said firing pin may pass through the relatively large diameter opening therein to strike said cartridge, and when said bolt is in the safety position, said firing pin cannot pass through the relatively small diameter opening therein, whereby to prevent said firing pin from reaching said cartridge.

17. The gun of claim 16, wherein said firing pin has a collar formed therearound and said relatively small diameter opening has a peripheral ledge, said collar being engaged by and seated against said ledge to block the passage of said firing pin through said small diameter opening and toward said cartridge when said firing pin block bolt is moved to the safety position and said firing pin is aligned with said small diameter opening.

18. In a gun having a spring-loaded hammer, a trigger and a sear cooperating with the trigger to releasably support the hammer until the trigger is pulled, the improvement comprising:

safety means including a shaft having a manually actuable lever at one end and an opposite free end adapted to be inserted transversely through the gun from a side thereof, said lever rotating the shaft between fire and safety positions; and said shaft having means to engage the sear and thereby prevent a release of the hammer and a discharge of the gun when said lever rotates said shaft to the safety position.

19. The gun of claim 18, wherein said shaft engagement means comprises at least one member projecting outwardly from said shaft, said outwardly projecting member being rotated with said shaft to engage said sear and thereby prevent a release of the hammer and a discharge of the gun when said lever rotates said shaft to the safety position, and the outwardly projecting member being rotated out of engagement with said sear to release the hammer and permit a discharge of the gun when said lever rotates said shaft to the fire position.

20. The gun of claim 19, wherein said sear also has at least one outwardly projecting member, said sear projecting member positioned so as to be engaged by said shaft projecting member when said lever rotates said shaft to the safety position.

21. The gun of claim 18, further comprising a sear housing to pivotally receive said sear therewithin and means to releasably retain said shaft within said sear housing, said retaining means comprising a sear spring having first and second projecting ends, a first projecting end of said sear spring engaging a notch in said shaft and an aligned slot in said sear housing, and the second projecting end of said spring engaging said sear to bias said sear in a hammer supporting position.

22. The gun of claim 21, wherein said sear spring is a coil spring, the coil of said spring being carried by a pin which pivotally supports the sear within said sear housing.

* * * * *